US008534350B2

(12) United States Patent
Sultenfuss et al.

(10) Patent No.: US 8,534,350 B2
(45) Date of Patent: Sep. 17, 2013

(54) RF FRACTURING TO IMPROVE SAGD PERFORMANCE

(75) Inventors: Daniel R. Sultenfuss, Houston, TX (US); Wendell Menard, Katy, TX (US); Wayne R. Dreher, Jr., College Station, TX (US); Curtis G. Blount, Katy, TX (US); Francis E. Parsche, Palm Bay, FL (US); Mark A. Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 36 days.

(21) Appl. No.: 13/231,912

(22) Filed: Sep. 13, 2011

(65) Prior Publication Data

US 2012/0061081 A1 Mar. 15, 2012

Related U.S. Application Data

(60) Provisional application No. 61/382,763, filed on Sep. 14, 2010, provisional application No. 61/414,744, filed on Nov. 17, 2010.

(51) Int. Cl.
*E21B 43/26* (2006.01)

(52) U.S. Cl.
USPC ..... 166/247; 166/272.2; 166/272.3; 166/259; 166/302; 166/308.1; 166/297; 166/372

(58) Field of Classification Search
USPC ..... 166/247, 272.3, 259, 302, 308.1, 166/297, 372
See application file for complete search history.

(56) References Cited

U.S. PATENT DOCUMENTS

| | | | | |
|---|---|---|---|---|
| 4,265,310 | A * | 5/1981 | Britton et al. | 166/259 |
| 7,591,306 | B2 * | 9/2009 | Hocking | 166/250.1 |
| 2007/0289736 | A1 * | 12/2007 | Kearl et al. | 166/248 |
| 2010/0078163 | A1 * | 4/2010 | Banerjee et al. | 166/248 |
| 2010/0294489 | A1 * | 11/2010 | Dreher et al. | 166/248 |

FOREIGN PATENT DOCUMENTS

WO PCT/US11/51475 5/2011

* cited by examiner

*Primary Examiner* — Zakiya W Bates
*Assistant Examiner* — Silvana Runyan
(74) *Attorney, Agent, or Firm* — Boulware & Valoir

(57) ABSTRACT

A method of producing heavy oil from a heavy oil formation with steam assisted gravity drainage. The method begins by drilling a borehole into a heavy oil formation comprising a steam barrier between a first pay zone and a second pay zone, wherein the steam barrier prevents a steam chamber to be formed between the first pay zone and the second pay zone. The steam barrier is then heated with a radio frequency. The steam barrier is then fractured to permit a steam chamber to be formed within the first pay zone and the second pay zone. Heavy oil is then produced from the heavy oil formation with steam assisted gravity drainage.

14 Claims, 6 Drawing Sheets

RF FRACTURING TO IMPROVE SAGD PERFORMANCE

CROSS-REFERENCE TO RELATED APPLICATIONS

This application claims priority to U.S. Provisional Nos. 61/382,763, filed Sep. 14, 2010, and 61/414,744, filed Nov. 17, 2010, each of which is incorporated herein in its entirety.

STATEMENT REGARDING FEDERALLY SPONSORED RESEARCH

None.

FIELD OF THE INVENTION

A method of fracturing shale and mudstone layers to improve SAGD performance.

BACKGROUND OF THE INVENTION

Bitumen (colloquially known as "tar" due to its similar appearance, odor, and color) is a thick, sticky form of crude oil, so heavy and viscous (thick) that it will not flow unless heated or diluted with lighter hydrocarbons. Bituminous sands—colloquially known as oil sands (or tar sands) contain naturally occurring mixtures of sand, clay, water, and bitumen and are found in extremely large quantities in Canada and Venezuela.

Conventional crude oil is normally extracted from the ground by drilling oil wells into a petroleum reservoir, and allowing oil to flow into the wells under natural reservoir pressures. Artificial lift techniques, such as water flooding and gas injection, are usually required to maintain production as reservoir pressure drops toward the end of a field's life, but initial production proceeds under normal reservoir pressures and temperatures.

Oil sands are very different however. Because extra-heavy oil and bitumen flow very slowly, if at all, toward producing wells under normal reservoir conditions, oil sands must be extracted by strip mining or the oil made to flow into wells by in situ techniques that reduce the viscosity by injecting steam, solvents, gases or other forms of energy into the sands to heat or otherwise reduce the viscosity of the heavy oil. These processes can use more water and require larger amounts of energy than conventional oil extraction, and thus heavy oils cost more to produce than conventional oils.

The use of steam injection to recover heavy oil has been in use in the oil fields of California since the 1950s. In Cyclic Steam Stimulation ("CSS") or "huff-and-puff" the well is put through cycles of steam injection, soak, and oil production. First, steam is injected into a well at a temperature of 300 to 340 degrees Celsius for a period of weeks to months. The well is then allowed to sit for days to weeks to allow heat to soak into the formation. Later, the hot oil is pumped out of the well, again for a period of weeks or months. Once the production rate falls off, the well is put through another cycle of injection, soak and production. This process is repeated until the cost of injecting steam becomes higher than the money made from producing the oil. The CSS method has the advantage that recovery factors are around 20 to 25% and the disadvantage that the cost to inject steam is high, and it is often not cost effective to produce heavy oil this way.

Steam Assisted Gravity Drainage (SAGD) is another enhanced oil recovery technology that was developed in the 1980s and fortuitously coincided with improvements in directional drilling technology that made it quick and inexpensive to do by the mid 1990s. In the SAGD process, at least two parallel horizontal oil wells are drilled in the formation, one about 4 to 6 meters above the other. Steam is injected into the upper well, possibly mixed with solvents, and the lower one collects the heated crude oil or bitumen that flows out of the formation, along with any water from the condensation of injected steam.

The basis of the SAGD process is that the injected steam forms a "steam chamber" that grows vertically and horizontally in the formation. The heat from the steam reduces the viscosity of the heavy crude oil or bitumen, which allows it to gravity drain into the lower wellbore. The steam and gases rise because of their low density compared to the heavy crude oil below, ensuring that steam is not produced at the lower production well.

The gases released, which include methane, carbon dioxide, and usually some hydrogen sulfide, tend to rise in the steam chamber, filling the void space left by the oil and, to a certain extent, forming an insulating heat blanket above the steam. The condensed water and crude oil or bitumen gravity drains to the lower production well and is recovered to the surface by pumps, such as progressive cavity pumps, that work well for moving high-viscosity fluids with suspended solids.

Although SAGD techniques have been very successful, one factor that can limit the economic production of the viscous oil using SAGD is the heterogeneous nature of the reservoir. The applicability of SAGD is often limited by impermeable layers (such as shale and mudstone) that act as barriers to vertical flow. The impermeable layers effectively compartmentalize the reservoir into thin sub-reservoirs, less than 15 meters in length at its minimum. These thin layers cannot be economically developed with gravity drainage processes because of the thickness requirement for cost effective production.

Thus, what is needed in the art are methods of improving the cost effectiveness of recovering heavy oils, even in heterogeneous reservoirs that are vertically compartmentalized.

BRIEF SUMMARY OF THE DISCLOSURE

In one embodiment the method utilizes a unique method to fracture the impermeable layers and establish vertical communication between the isolated sub-reservoirs and allow a gravity drainage process to work. Preferably, the fracturing is achieved with the application of radio frequency ("RF") energy, but RF energy can be combined with conventional fracturing fluids and/or proppants. The use of RF energy in this unusual way improves the efficiency of the fracturing, thus improving overall cost effectiveness.

The method begins by drilling a borehole into a heavy oil formation comprising a steam or flow barrier between a first pay zone and a second pay zone, wherein the flow barrier prevents a steam chamber to be formed between the first pay zone and the second pay zone. The steam barrier itself is then heated with a radio frequency. The steam barrier is thus fractured to permit a steam chamber to be formed within the first pay zone and the second pay zone. Heavy oil is then produced from the heavy oil formation with steam assisted gravity drainage.

In an alternate embodiment, the method discloses a method of producing heavy oil from a heavy oil formation with steam assisted gravity drainage. The method begins by drilling a borehole into a heavy oil formation comprising a steam barrier between a first pay zone and a second pay zone, wherein the steam barrier prevents a steam chamber to be formed between the first pay zone and the second pay zone and wherein the minimum depth of at least one pay zone is less than about 15 meters. The method then perforates the heavy oil formation with a perforating gun, followed by injecting a fracturing fluid into the heavy oil formation. The steam barrier is then heated with a radio frequency. The steam barrier is then fractured with the fracturing fluid to permit a steam chamber to be formed within the first pay zone and the second pay zone. Heavy oil is then produced from the heavy oil formation with steam assisted gravity drainage, wherein the steam chamber extends from the first pay zone into the second pay zone.

In an alternate embodiment, the method discloses a method of producing heavy oil from a heavy oil formation with steam assisted gravity drainage. The method begins by drilling a borehole into a heavy oil formation comprising a steam barrier between an upper pay zone and a lower pay zone, wherein the steam barrier prevents a thermal connection to be formed between the upper pay zone and the lower pay zone and wherein the depth (e.g., vertical thickness) of at least one pay zone is less than about 15 meters. The method then perforates the heavy oil formation with a perforating gun, if needed, followed by injecting a fracturing fluid into the heavy oil formation. In this embodiment the fracturing fluid can optionally also contain a proppant. The steam barrier is then heated with a radio frequency and the combination RF and fracturing fluid fracture the barrier, and allow the steam chamber to be formed within the upper pay zone and the lower pay zone. The proppant, if used, props the fractures open and prevents their collapse. The pressure used to fracture the steam barrier is less than what is necessary to fracture the steam barrier prior to heating with the radio frequency. Heavy oil is then produced from the heavy oil formation with steam assisted gravity drainage with a steam oil ratio less than 3.5, preferably less than 3.0 or 2.5.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

A method of producing heavy oil from a heavy oil formation with steam assisted gravity drainage is described. The method begins by drilling a borehole into a heavy oil formation comprising a steam barrier between a first pay zone and a second pay zone, wherein the steam barrier prevents a steam chamber to be formed between the first pay zone and the second pay zone. The steam barrier is then heated with a radio frequency. The steam barrier is then fractured to permit a steam chamber to be formed within the first pay zone and the second pay zone. Heavy oil is then produced from the heavy oil formation with steam assisted gravity drainage.

By "steam barrier" herein what is meant is a natural barrier to oil production that is generally an oil impermeable layer, usually of rock, such as shale or mudstone. Such barriers must be fractured in order to allow gravity drainage of pay zones above the steam barrier.

Figure 1:
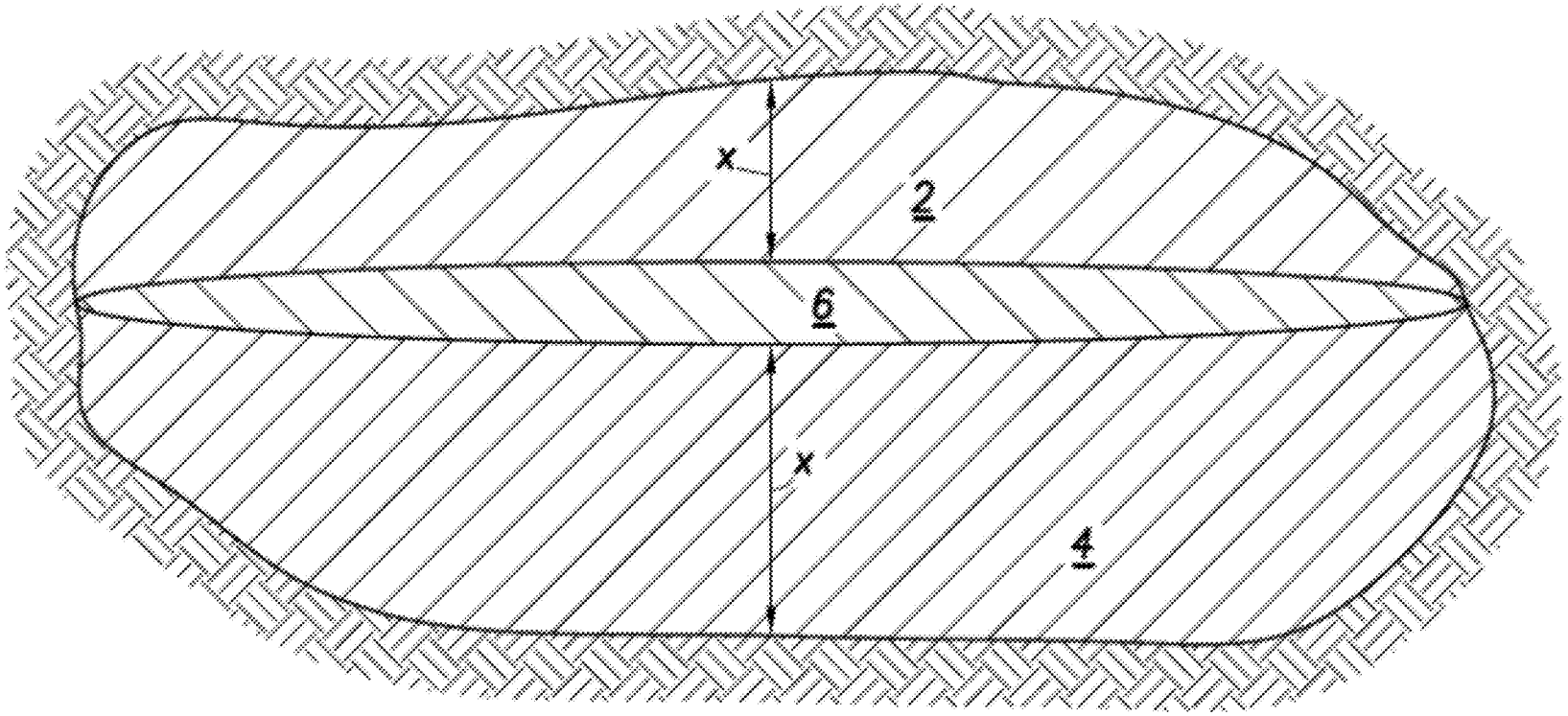
FIG. 1 depicts a heavy oil formation with a steam barrier—typically a layer of impermeable shale or mudstone. The primary pay zone, 4, is where a normal SAGD operation would be preformed to recover the oil in this region. The steam barrier, 6, sits above the main pay zone and prevents recovery from the stranded resource above, 2.

As shown in FIG. 1, the first pay zone 2 and the second pay zone 4 are separated by a steam barrier 6. The steam barrier 6 prevents a steam chamber from being formed between the first pay zone and the second pay zone, thereby reducing the effectiveness of producing oil via steam assisted gravity drainage. In one embodiment the steam to oil ratio is higher than 3.5 when steam assisted gravity drainage is performed in either the first pay zone or the second pay zone prior to fracturing the steam barrier, but is reduced below 3.0 or below 2.5 when the field is RF fractured prior to development.

The present embodiment can be used in any situation where a steam barrier prevents the formation of a steam chamber between two or more pay zones to a bitumen thickness greater than 20 meters. In one embodiment the minimum distance of at least one pay zone, indicated by x in FIG. 1 is less than about 20 meters. The cost of operating a steam assisted gravity drainage operation in a pay zone less than about 20 meters would typically cause the operation not to be cost effective. In alternate embodiments the pay zone is less than about 19, 18, 17, 16, 15, 14, 13, 12, 11, 10, 9, 8, 7, 6, 5, 4, 3, 2 or 1 meter in distance.

The perforation of the well can be done by any conventional method known to one skilled in the art. Typically perforation refers to a hole punched in the casing or liner of an oil well to connect it to the reservoir. In cased hole completions, the well will be drilled down past the section of the formation desired for production and will have casing or a liner run in separating the formation from the well bore. The final stage of the completion will involve running in perforating guns, a string of shaped charges, down to the desired depth and firing them to perforate the casing or liner. A typical perforating gun can carry many dozens of charges.

After the perforation of the well a fracturing fluid can then be injected into the fracture to form a hydraulic fracture. A hydraulic fracture is typically formed by pumping the fracturing fluid into the wellbore at a rate sufficient to increase the pressure downhole to a value in excess of the fracture gradient of the formation rock. The pressure causes the formation to crack, allowing the fracturing fluid to enter and extend the crack further into the formation.

To keep this fracture open after the injection stops, a solid proppant can be added to the fracture fluid. The proppant, which is commonly a sieved round sand, is carried into the fracture. This sand is chosen to be higher in permeability than the surrounding formation, and the propped hydraulic fracture then becomes a high permeability conduit through which the formation fluids can flow to the well.

Different fracturing fluids can be used as long as they have characteristics such as:

- fluid enough to be easily pumped by the usual well completion pumps,
- capable of holding a propping material while being pumped down the well but also must be capable of depositing the propping material in the cracks of the formation,
- able to flow into the cracks in the formation with minimal fluid loss into the pores,
- should not plug pores of the formation completely or the capacity of the formation to produce oil will be damaged,
- compatible with the hydrocarbon production from the well being fractured under the pressure and temperature conditions found in the well bore.

Examples of fracturing fluids that can be used include: water to gels, foams, nitrogen, carbon dioxide or air. In addition to the fracturing fluids different additives can be added to enhance the fracturing fluids such as: acid, glutaraldehyde, sodium chloride, n,n-dimethyl formamide, borate salts, polyacrylamide, petroleum distillates, guar gum, citric acid, potassium chloride, ammonium bisulfite, sodium or potassium carbonate, various proppants, ethylene glycol, and/or isopropanol.

In preferred embodiments the steam barrier is heated by radio frequencies and the combination of RF heating and fracturing fluid causes the steam barrier to be more easily fractured, thus improving the costs effectiveness of the method. While not wishing to be bound by theory, it is believed that the increased heat provide by the application of RF energies contributes to pressurization and thus to fracturing, but the heat may also make the steam barrier more susceptible to fracturing as different components of the barrier react differentially to the heat and the RF waves, e.g., some constituents may expand more than others. The trapped water in shales and the clays in mudstones make them susceptible to heating by RF. Shales will dehydrate as they are heated, causing them to crack. This also suggests that we should be able to fracture the shales and mudstones without the use of fracturing fluids, solely using RF energy.

Microwave frequency generators are operated to generate microwave frequencies capable of causing maximum excitation of the substances in the steam barrier. Examples of substances present in the steam barrier include: water or salt water used in SAGD operations, asphaltene, heteroatoms and metals, and these various constituents are expected to react different to both RF energies, as well as to the heat created by exposure to RF energies.

For some embodiments, the microwave frequency generator defines a variable frequency source of a preselected bandwidth sweeping around a central frequency. As opposed to a fixed frequency source, the sweeping by the microwave frequency generator can provide time-averaged uniform heating of the hydrocarbons with proper adjustment of frequency sweep rate and sweep range to encompass absorption frequencies of constituents, such as water and the microwave energy absorbing substance, within the mixture.

The microwave frequency generator may produce microwaves or radio waves that have frequencies ranging from 0.3 gigahertz (GHz) to 100 GHz. For example, the microwave frequency generator may introduce microwaves with power peaks at a first discrete energy band around 2.45 GHz associated with water and a second discrete energy band spaced from the first discrete energy band and associated with the components with existing dipole moments in the steam barrier. The Debye resonance of water in the vapor phase at 22 GHz is another example frequency. In other embodiments, a reduced frequency can be used, e.g., in between 100 MHz and 1000 MHz, and we prefer to use these lower frequency, because microwaves do not have the penetration range that low frequency radio wave have and do not penetrate deep enough into the formation.

By heating the steam barrier with an electromagnetic wave in the radio frequency range, the pressure required to fracture the steam barrier is less than what is necessary the fracture the steam barrier prior to RF heating. The pressure can be reduced with this method anywhere from 3 psi to 0.05 psi. In alternate embodiments the pressure can be reduced by 0.1, 0.25, 0.5, 0.75, 1, 1.25, 1.5, 1.75 or even 2 psi.

In one embodiment the fracturing of the steam barrier permits a steam chamber to be formed within the first pay zone and the second pay zone. By enlarging the space for the steam chamber the steam to oil ratio is lower than 3.5, and preferably less than 3.0 or 2.5 when the steam assisted gravity drainage is performed in the steam chamber.

In some embodiments, cyclic steam stimulation, vapor extraction, J-well steam assisted gravity drainage, in situ combustion, high pressure air injection, expanding solvent steam assisted gravity drainage or cross-steam assisted gravity drainage can be used to produce oil from the heavy oil formation once the RF fracturing has been achieved.

Figure 2:
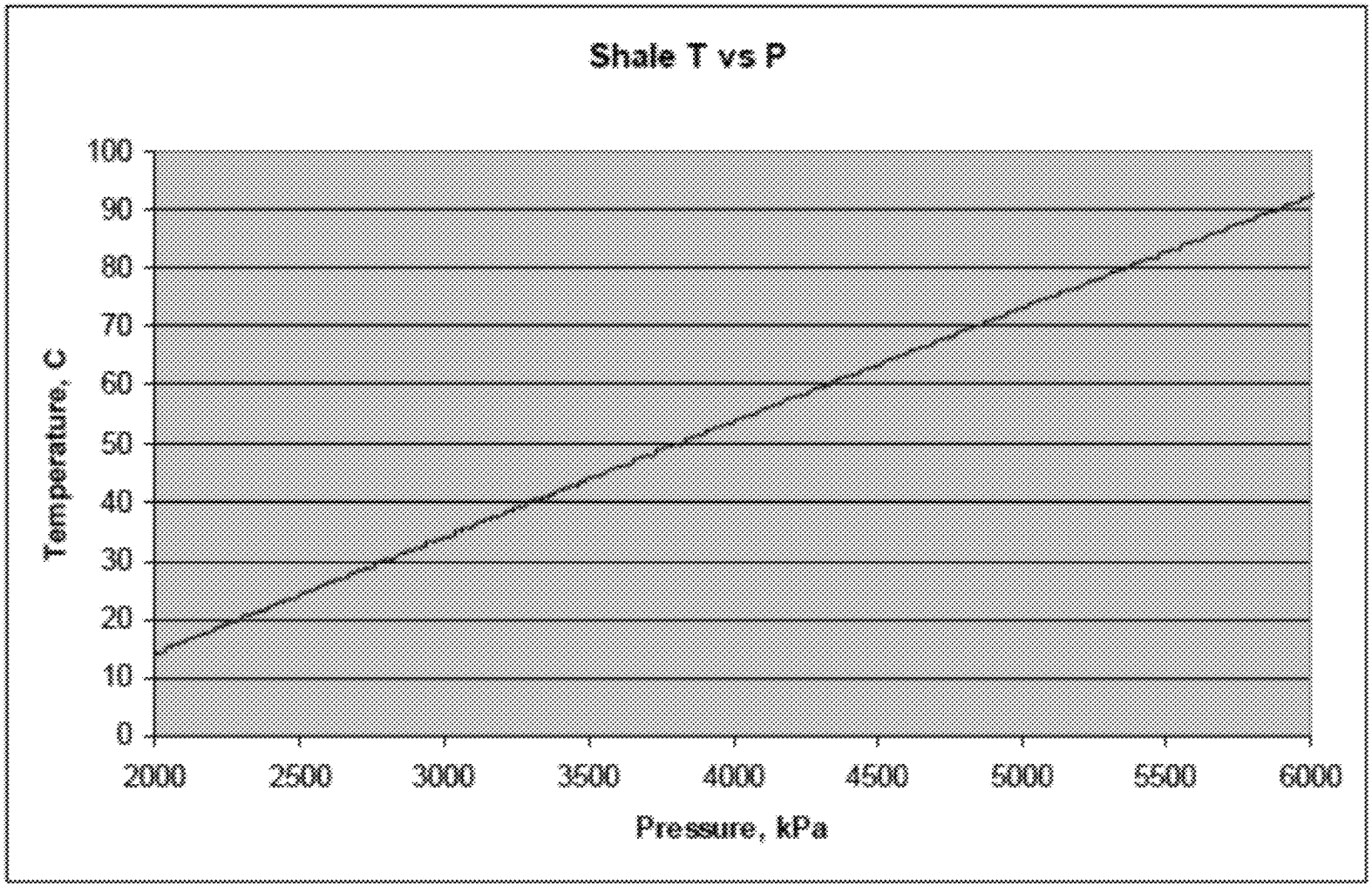
FIG. 2 is a simulated graph of temperature versus pressure. It illustrates the internal pore pressure of shale as the temperature increases.

The results of simulations in support of this invention are shown in FIGS. 2-6. FIG. 2 investigates feasibility of shale breaking using RF. It shows that if shale reaches about 90° C. (which is a reasonable temperature to achieve in RF heating applications), the internal pore pressure reaches 6000 kPa, which is more than enough to fracture shale.

Figure 3:
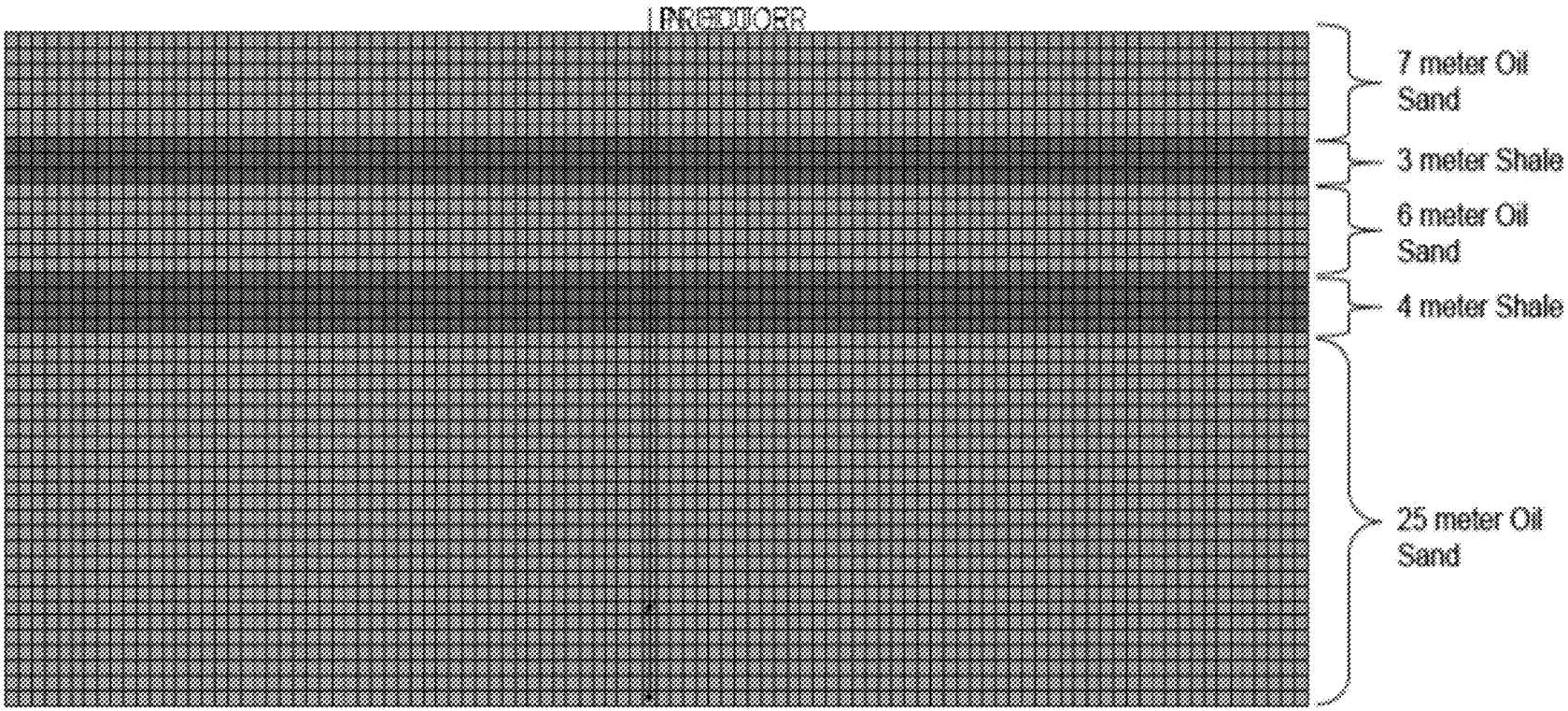
FIG. 3 is a graphic illustrating a typical vertically segregated oil formation, with impermeable shale layers separating the pay zone oil sands.
Figure 4:
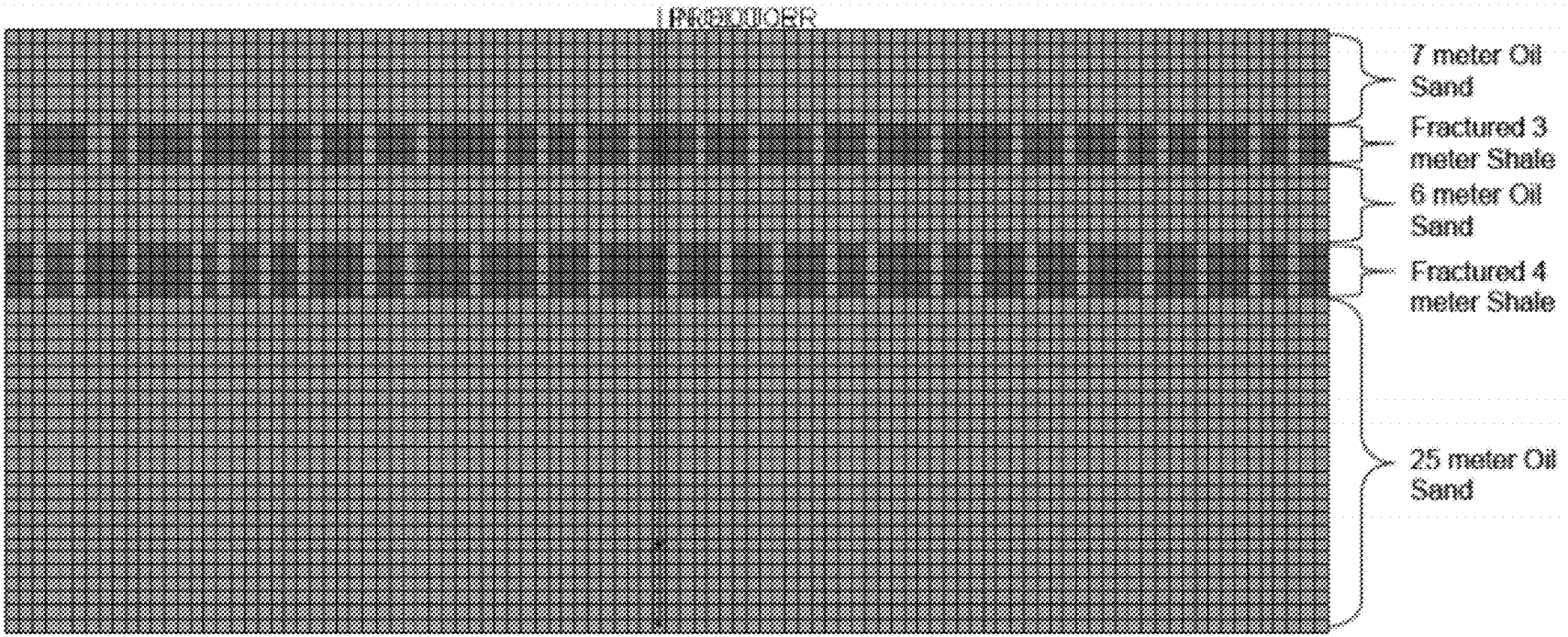
FIG. 4 is a graphic illustrating the same vertically segregated oil formation, wherein the impermeable shale layers have been fractured.
Figure 5:
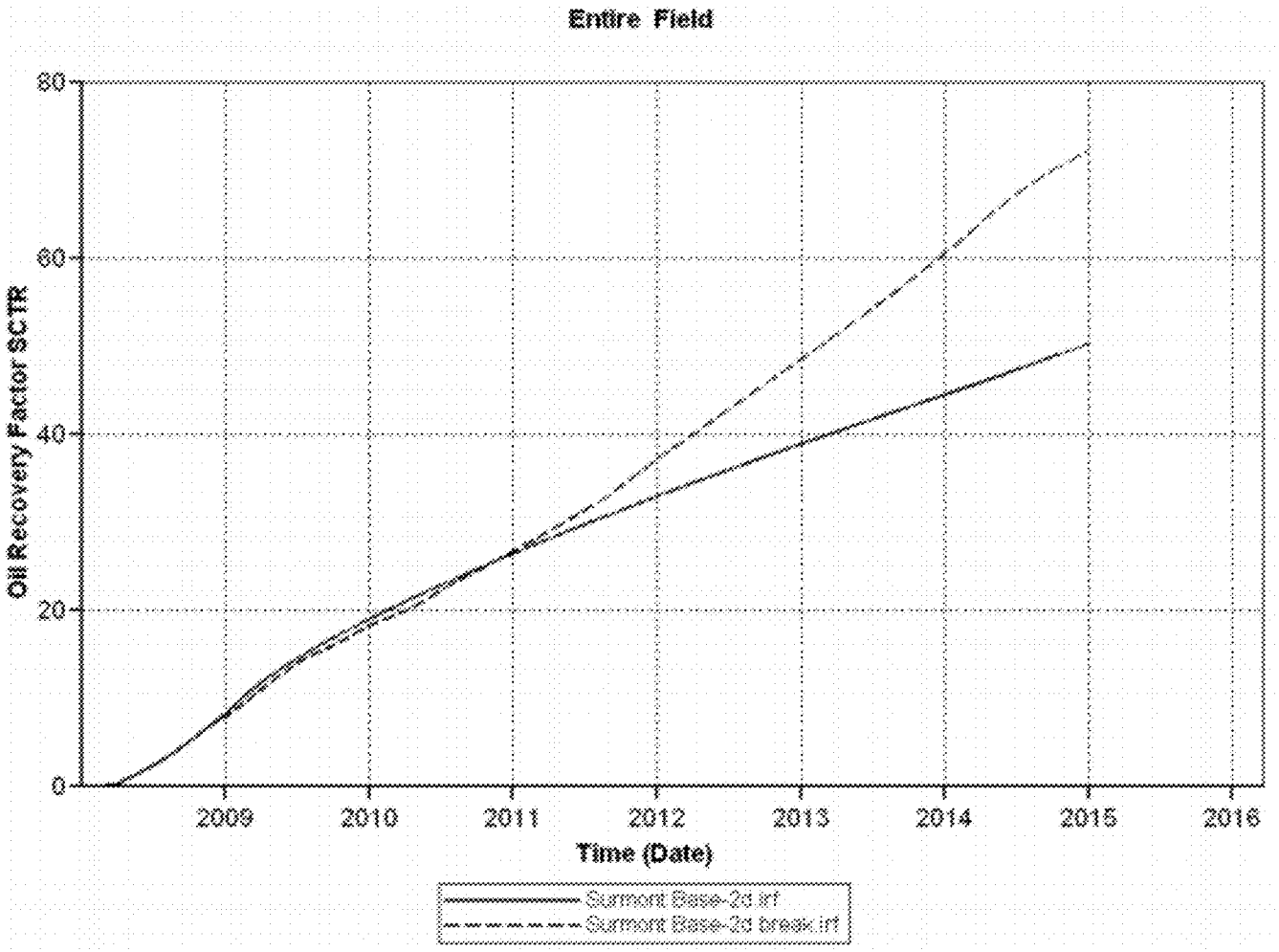
FIG. 5 shows a simulated Oil Recovery Factor SCTR versus time in years, at the ConocoPhillips Surmont field, located 75 km southeast of Fort McMurray, Alberta. The solid line represents the unfractured field, while the dotted line is the fractured field. This data was generated using CMG's STARS™ thermal simulator.
Figure 6:
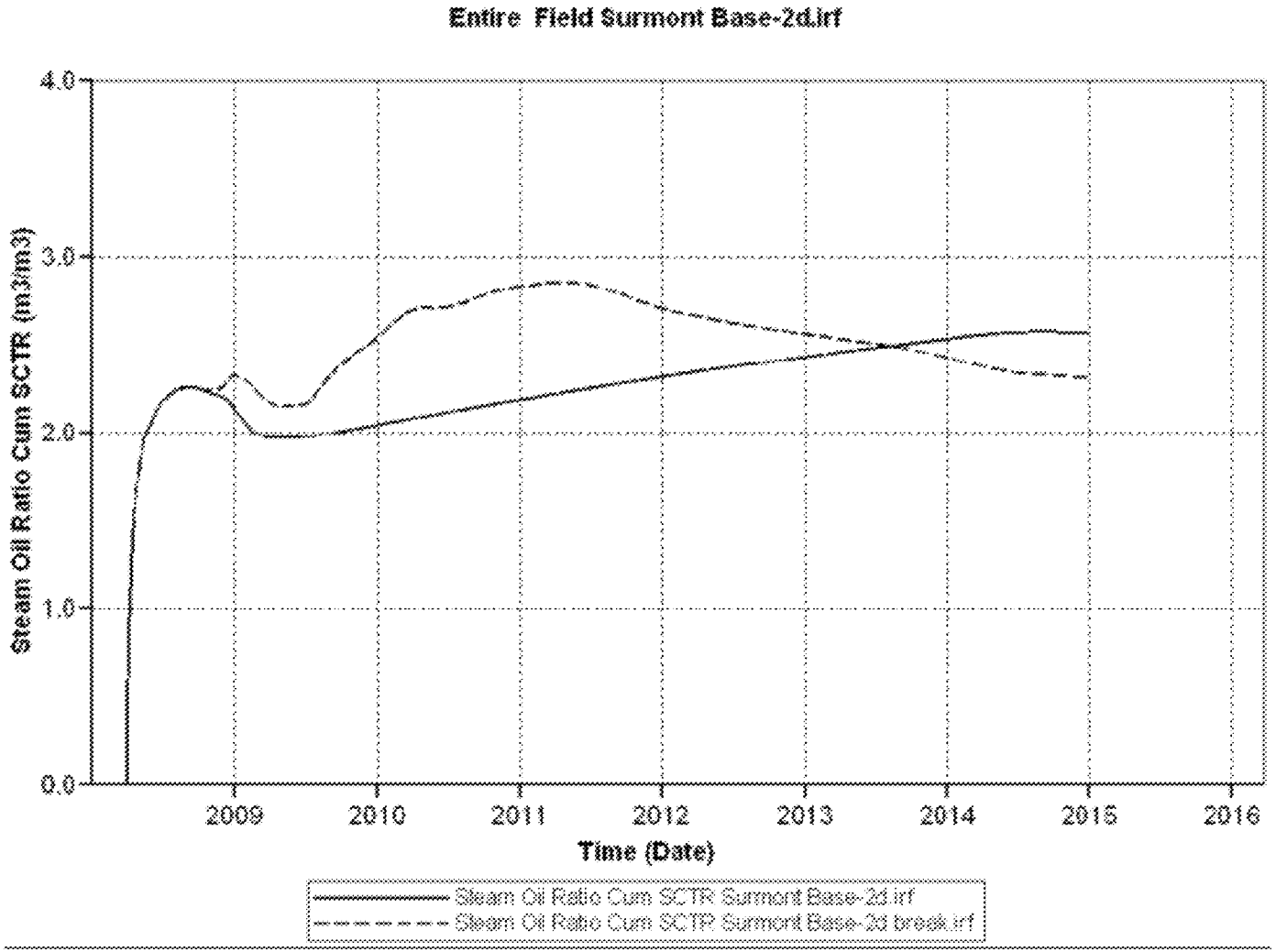
FIG. 6 shows simulated a Steam Oil Ratio Cumulative SCTR versus time in years. The solid line represents the unfractured field, while the dotted line is the fractured field. As is apparent, it takes more steam to recover the would be stranded resource during the projects middle period, but in the end, the project's CSOR is less and significantly more oil is recovered.

FIG. 3 is computational domain with shale layers with no fractures. FIG. 4 is a computational domain with fractured shale layers. FIG. 5 shows the oil recovery for both cases, and FIG. 6 shows the steam-to-oil ratio ("SOR") for both cases. As can be seen, the RF fracturing improves SOR ratios and improves recoveries.

Steam-to-oil ratios are used to monitor the efficiency of oil production processes based on steam injection. Commonly abbreviated as SOR, it measures the volume of steam required to produce one unit volume of oil. Typical values of SOR for cyclic steam stimulation are in the range of three to eight, while typical SOR values for steam assisted gravity drainage are in the range of two to five. The lower the SOR, the more efficiently the steam is utilized and the lower the associated fuel costs.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method comprising of producing heavy oil from a vertically segregated subsurface formation, said method comprising:

a. providing a borehole into a vertically segregated subsurface formation containing heavy oil and comprising a steam barrier between a first pay zone and a second pay zone, wherein said steam barrier prevents a steam chamber being formed between the first pay zone and the second pay zone;

b. heating the steam barrier with an electromagnetic wave of radio frequency (RF) between 100 MHz and 1000 MHz at a frequency appropriate to heat a non-water steam barrier component with an existing dipole moment;

c. fracturing the steam barrier to permit a steam chamber to be formed within the first pay zone and the second pay zone; and d. producing heavy oil from the heavy oil formation.

2. The method of claim 1, wherein the maximum vertical thickness of at least one pay zone is ≦15 meters.

3. The method of claim 1, wherein RF heats the steam barrier to a temperature of about 90° C.

4. The method of claim 1, wherein the steam chamber extends from the first pay zone into the second pay zone.

5. The method of claim 1, wherein the heavy oil is produced by steam assisted gravity drainage.

6. The method of claim 1, wherein the heavy oil is produced by steam assisted gravity drainage, vapor assisted gravity drainage, cyclic steam stimulation, in situ combustion, in situ combustion, high pressure air injection, expanding solvent steam assisted gravity drainage or cross-steam assisted gravity drainage or combinations thereof.

7. The method of claim 1, where a second frequency at about 2.45 GHz or 22 GHz is also applied.

8. The method of claim 1, wherein the steam to oil ratio would be higher than 3.5 when steam assisted gravity drainage is performed in either the first pay zone or the second pay zone prior to fracturing the steam barrier.

9. The method of claim 1, further comprising injecting a fracturing fluid into said borehole prior to said fracturing step.

10. The method of claim 1, further comprising injecting a fracturing fluid and a proppant into said borehole prior to said fracturing step.

11. The method of claim 1, wherein the heavy oil formation is perforated with a perforating gun.

12. The method of claim 11, wherein the steam to oil ratio is lower than 3.0.

13. The method of claim 11, wherein the steam to oil ratio is lower than 2.5.

14. A method comprising:

a. providing a borehole into a heavy oil formation comprising a steam barrier between an upper pay zone and a lower pay zone wherein the minimum vertical thickness of at least one pay zone is less than about 15 meters and the steam barrier prevents a thermal connection between the upper pay zone and the lower pay zone;

b. optionally perforating the heavy oil formation with a perforating gun;

c. injecting a fracturing fluid into the heavy oil formation, wherein the fracturing fluid contains a proppant;

d. heating the steam barrier to a temperature of about 90° C. with a radio frequency energy between 100 MHz and 1000 MHz at a frequency appropriate to heat a non-water steam barrier component with an existing dipole moment e. vertically fracturing the steam barrier with the fracturing fluid to permit a thermal connection between the upper pay zone and the lower pay zone, wherein the pressure used to fracture the steam barrier is less than what is necessary to fracture the steam barrier prior to heating with the radio frequency; and f. producing heavy oil from the heavy oil formation with steam assisted gravity drainage with a steam to oil ratio less than 3.0.

* * * * *